US009401560B2

(12) United States Patent
Gilliam

(10) Patent No.: US 9,401,560 B2
(45) Date of Patent: Jul. 26, 2016

(54) HIGH POWER SINGLE-POLE ELECTRICAL CONNECTOR

(71) Applicant: Charles David Gilliam, Baton Rouge, LA (US)

(72) Inventor: Charles David Gilliam, Baton Rouge, LA (US)

(73) Assignee: Hubbell Incorporated (Delaware), Shelton, CT (US)

( * ) Notice: Subject to any disclaimer, the term of this patent is extended or adjusted under 35 U.S.C. 154(b) by 274 days.

(21) Appl. No.: 13/953,814

(22) Filed: Jul. 30, 2013

(65) Prior Publication Data

US 2015/0038021 A1 Feb. 5, 2015

(51) Int. Cl.
*H01R 13/502* (2006.01)
*H01R 43/20* (2006.01)
*H01R 101/00* (2006.01)

(52) U.S. Cl.
CPC ..... *H01R 13/5025* (2013.01); *H01R 13/502* (2013.01); *H01R 43/20* (2013.01); *H01R 2101/00* (2013.01); *Y10T 29/49208* (2015.01)

(58) Field of Classification Search
CPC ..... H01R 13/5025; H01R 13/521; H01R 13/5202; H01R 2101/00
See application file for complete search history.

(56) References Cited

U.S. PATENT DOCUMENTS 3,830,525 A * 8/1974 Ransford, III ... H01R 13/62933 285/2
3,922,477 A * 11/1975 Glowacz ..... H01R 13/746 174/18
3,964,934 A * 6/1976 Ching, Jr. ..... H01M 2/30 429/178
4,280,093 A * 7/1981 Houston ..... G01R 19/175 324/117 R
4,420,202 A * 12/1983 Atakkaan ..... H01R 13/53 439/278
4,707,047 A * 11/1987 Michaels ..... H01R 13/5202 439/271
5,017,160 A * 5/1991 Garcia ..... E21B 17/028 439/271
7,530,843 B1 * 5/2009 Tesfay ..... H01R 4/183 439/587
8,109,776 B2 * 2/2012 Hughes ..... H01R 13/46 439/282
2002/0136018 A1 * 9/2002 Yoo ..... G03F 7/70016 362/484
2006/0063412 A1 * 3/2006 Matsumoto ..... H01R 13/5205 439/274
2008/0087466 A1 * 4/2008 Emerson ..... H02G 15/18 174/88 R
2008/0210455 A1 * 9/2008 Pollack ..... H01M 2/22 174/151
2011/0207368 A1 * 8/2011 Takada ..... H01R 13/521 439/519
2012/0113569 A1 * 5/2012 Peralta ..... H02G 5/10 361/676
2013/0203284 A1 * 8/2013 Perotto ..... B29C 45/14639 439/530
2015/0038021 A1 * 2/2015 Gilliam ..... H01R 43/20 439/730

* cited by examiner

*Primary Examiner* — James Harvey
(74) *Attorney, Agent, or Firm* — Roy Kiesel Ford Doody & Thurmon

(57) ABSTRACT

A downsized, high-power, single-pole electrical connector is disclosed. The connector employs an insulating axial positioner between two rigid insulators, such that the insulating axial positioner maintains proper internal axial alignment while allowing for use of a smaller outer shell.

17 Claims, 2 Drawing Sheets

HIGH POWER SINGLE-POLE ELECTRICAL CONNECTOR

FIELD OF INVENTION

The present invention relates to an electrical connector, and in particular to a high power, single pole electrical connector having a reduced-size outer shell or casing.

BACKGROUND AND SUMMARY OF THE INVENTION

Large, high-power, single-pole electrical connectors are used in a variety of industrial settings. One such setting is the oil and gas exploration and production industry. This industry can be divided into two major segments: offshore operations and land-based operations. This distinction is important for a number of reasons, including the type of electrical systems used.

Offshore oil and gas operations typically use semi-permanent electrical systems. These systems may be more resistant to the sometimes extreme environmental demands and may provide increased reliability. In these systems, there often are more hard-wired connections (i.e., as compared to land-based operations), and fewer single-pole electrical connectors of the general type discussed below.

Land-based oil and gas operations, on the other hand, typically use more portable systems. In many instances, most of the equipment, perhaps all of it, is transported to the site using a commercial truck. This means the equipment must not exceed the size limits of such trucks. In practical terms, this frequently means that single pieces of equipment cannot be more than eight to nine feet wide or tall.

These constraints have significant impact on the design of electrical distribution systems for land-based operations. Land-based operations have become increasingly complex, with many land-based operations now involving long horizontal drilling runs or other complex, steered drilling operations. With the increase in complexity comes an increase in the equipment and power demands. For example, in operations that involve long drilling runs, more and more powerful equipment may be needed.

These demands mean more electrical loads. More electrical loads means more electrical supply and distribution lines. And more lines means more connections on the distribution panel. In a typical land-based drilling operation, a prefabricated "box" is used for the electrical supply and distribution hub. This box has one or more sides that are designed for use as a distribution panel. On this panel will be mounted many electrical receptacles, which are designed to accept cable-end plugs. The cables run from the distribution panel to the electrical equipment. At the distribution panel, there are typically a large number of panel-mounted receptacles (of either male or female design). When the system is fully made up, there are many cables running to the panel, with each cable having a plug that is connected to a matching receptacle.

As the number of size of the electrical loads on land-based rigs has increased, the number of panel-mounted receptacles has increased. It is now common to find distribution panels completely filled with panel-mounted receptacles. And even that is sometimes not enough.

The same situation may occur in other industrial settings. Indeed, there may be many situations where there is a need or desire to reduce the overall size of a distribution panel or to fit more receptacles on such a panel. The present invention may be of benefit in all these situations.

There are only a few ways to get more receptacles on a distribution panel. First, the spacing between receptacles could be reduced. This is already done on many installations. Moreover, certain panel-mount receptacles provide designs that are more conducive to such close spacing, and thus allow for more receptacles on a given size panel. This solution is limited, however, because there must be room to install the receptacles and make up the connections while retaining enough surface material of the panel to ensure the panel retains sufficient strength to support all the connectors and cables running to and from the panel.

A second solution is to make the distribution panels larger. For land-based oil and gas operations, this solution is limited by the size of the standard commercial truck and the desire to prefabricate the electrical box. Given these constraints, there is limited room for change in the size of the panel.

A third solution is to make the connectors smaller. If the panel-mounted receptacles and cable-end plugs are smaller, more of them will fit in a given space. There is, however, a drawback to this "solution." Smaller connectors typically have lower power ratings. If connectors with lower power ratings are used, it is quite possible, and probably quite likely, that more connectors will be needed to supply the loads. This result tends to defeat the purpose of using smaller connectors. This may be one reason that most land-based drilling rigs use only high-power connectors. Going to smaller connectors might only make the situation worse, by requiring use of even more connectors.

There is a need for a downsized high-power connector. The need is not for merely a smaller connector with a lower power rating, but for a physically smaller connector that provides the same, or nearly the same, power ratings as the large connectors in wide use today. This need has existed for a long time, but it has become more acute as the competition increases for space on fixed-size electrical distribution panels.

High-power, single-pole connectors are typically made of several parts, which are assembled in a specific process. The core conductor, for example, is typically positioned within a rigid insulating sleeve, which is then placed inside a strong, metal shell. The sequence of these steps is not critical in most instances, as the insulating sleeve may be installed in the outer shell first, and the core conductor then installed inside the insulating sleeve. But regardless of the assembly sequent, it is critical that the axial positioning of the parts be maintained in use. To achieve that result, some type of retaining structure is used between the various parts. The core conductor, for example, is typically fixed in position relative to the rigid insulating sleeve with slip rings.

This design is described in more detail below (see FIGS. 4-5), but suffice it to say that space is required inside the connector for the retaining hardware (e.g., slip rings), including some space for the installation and possible removal of such hardware. This spacing is one factor in fixing the overall physical size of a particular connector. The core conductor is sized to provide a certain power rating, with larger conductors being rated for more power. The core conductor is typically of a size roughly comparable to that of the core of the electrical supply and distribution cables. The rigid insulation is sized based on the needed amount of insulation given the power rating of the connector. An additional amount of space is needed if the connector is to be sealed from water intrusion. Generally an O-ring is installed between the contact and the insulator and a second O-ring is installed between the insulator and the outer shell. The rigid insulator must also be sized to allow radial spacing to allow for the outer diameter of the contact plus the retaining ring and must also allow radial spacing for the O-rings if sealing is required.

None of these variables appears subject to alteration, and in fact, prior art connectors of this type are subject to all the limitations described above. The present invention, however, marks a significant change. The core conductor is no longer retained by slip rings or other similar hardware. Instead, an insulating axial positioner is used, as described below. This change in the design of the axial positioner allows the elimination of any radial spacing previously required for either a retaining ring or sealing O-rings. The entire radial distance between the outer diameter of the contact and the inside of the shell can be used for insulation thickness. Through use of this positioner and related changes to other components, the present invention is able to provide a downsized high-power, single-pole electrical connector.

Connectors of this type are housed in shells of standard sizes. The largest connectors use a size 24 shell. Connectors of this type may be used with cable sizes 646 mcm and 777 mcm. When used with these cables, a connector of this type may have current ratings as high as about 1000 A and 1100 A, respectively. A smaller connector might use a size 20 shell, but only be able to handle cable size up to 444 mcm. That configuration would typically provide a maximum current rating of about 800 A. This is a full 20% or more below the current ratings for a larger, size 24 shell connector.

The present invention provides a connector using a size 20 shell that can accommodate up to size 646 mcm cable. That means a size 20 shell connector embodying the present invention may have current rating of about 1000 A. The size 20 shell is about 20% smaller than the size 24 shell, resulting is a significant space savings. More of these downsized connectors may be installed on a given distribution panel without a loss of power capacity per connector. In fact, the present invention will work with even size 777 mcm cable. At present, however, the standard fittings used with cable of this size (e.g., the cable clamps) are larger than a size 20 housing, and the fittings become size limiting. By reducing the size of those components, it would be possible to use even size 777 mcm cable in a size 20 shell with the present invention.

These specific examples are merely illustrations of the benefits of the present invention. As the description provided below will make clear, the invention may be used to reduce the overall size of any high-power, single-pole electrical connector. This size reduction has other benefits, as well, because it is a smaller, lighter overall product. It takes up less space in storage, costs less to ship, and is easier to handle due to the reduced weight. All of these benefits are achieved without any loss of safety margin.

In a preferred embodiment, the present invention includes a core conductor, having a contact end, a cable end, and a retaining groove positioned near a midpoint between the contact end and the cable end; a rigid cable end insulator positioned radially outward of the core conductor and extending from the cable end to a point near the retaining groove; a rigid contact end insulator positioned radially outward of the core conductor and extending from the contact end to a point near the retaining groove; an insulating axial positioner located between the rigid cable end insulator and the rigid contact end insulator, the insulating axial positioner having a radially inner side and a radially outer side, the radially inner side inserted in the retaining groove of the core conductor; and, a shell positioned radially outward of the rigid cable end insulator, the rigid contact end insulator, and the insulating axial positioner.

An alternative embodiment of the present invention includes the following steps: inserting an insulating axial positioner into a retaining groove in a core conductor; inserting a first rigid insulator into a shell; inserting the core conductor into the first rigid insulator, such that the insulating axial positioner is in contact with the first rigid insulator; inserting a second rigid insulator into the shell; and, securing a barrel to the shell, such that the first and second rigid insulators compress the insulating axial positioner.

DETAILED DESCRIPTION OF THE INVENTION

Figure 1:
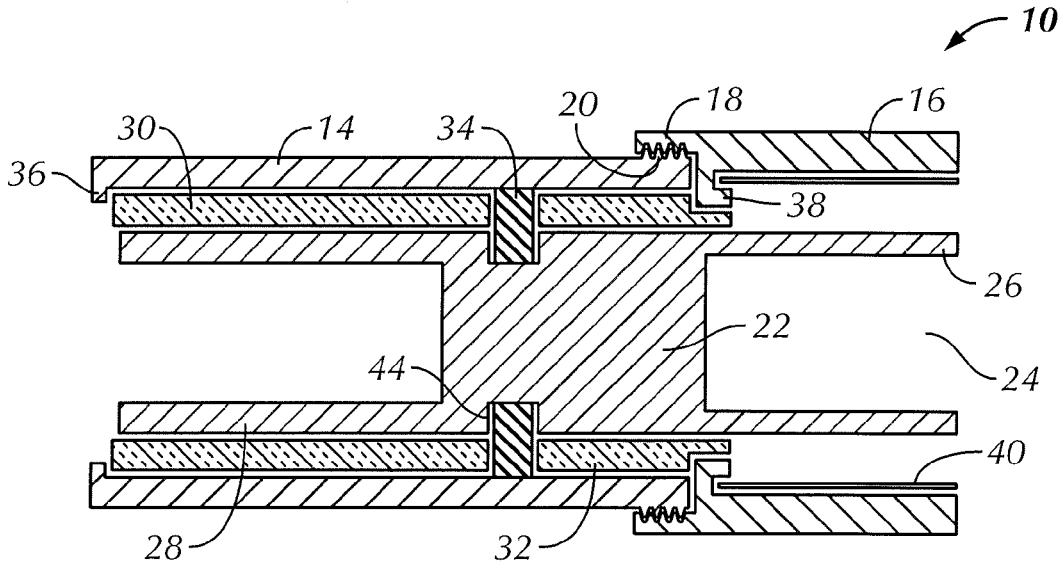
FIG. 1 is a cross-sectional, side view of a female connector of the present invention.
Figure 2:
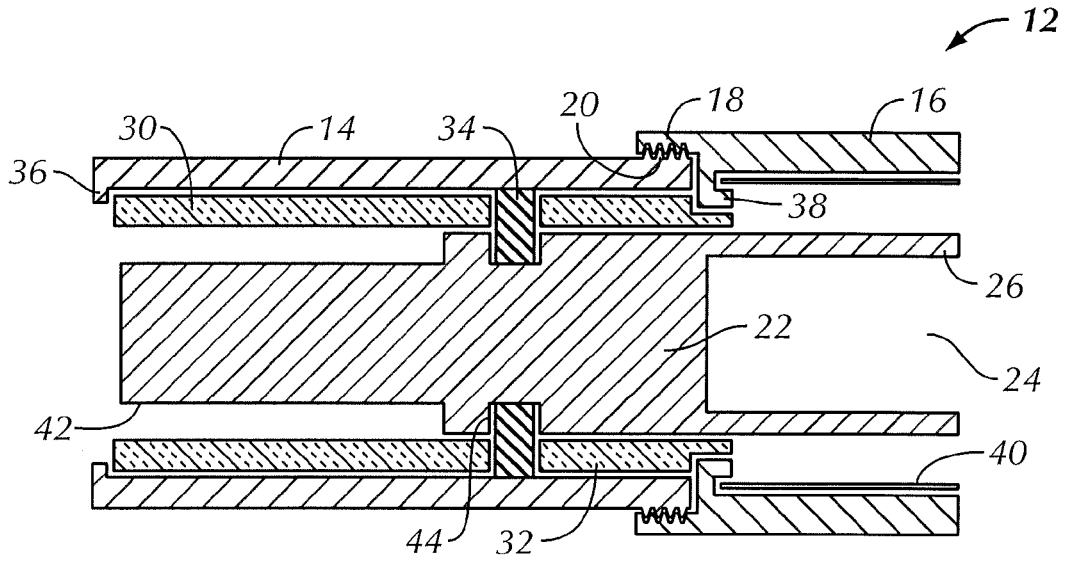
FIG. 2 is a cross-sectional, side view of a male connector of the present invention.

The downsized connector of the present invention is shown in cross-sectional, diagram form in FIGS. 1 and 2. A downsized female connector 10 is shown in FIG. 1, and a downsized male connector 12 is shown in FIG. 2. These are diagrammatical illustrations, showing the key components of preferred embodiments of the invention. The components of the connectors shown can be used in a panel-mounted receptacle of either male or female design. The components shown in these figures, and described in more detail below, also can be used in a cable-end plug, again of either male or female design. The installation and use of such components in these different connectors is well-known in the art.

The downsized female connector 10 shown in FIG. 1 has an outer metal shell 14 of cylindrical design. The inner surface of the shell 14 is generally smooth, and may be without any internal recesses or grooves. The shell 14 has a retaining lip 36 at one end and threads 20 at the other end. The shell 14 is attached to the metal barrel 16, which covers the cable end of the connector 10. The barrel threads 18 engage the shell threads 20 to connect the shell 14 to the barrel 16. The terms "shell" and "barrel" are arbitrarily chosen, and are not intended to indicate anything in particular about the size or nature of these components. For example, in a typical connector of the type described herein, the shell 14 may be substantially shorter than the barrel 16.

Figure 3:
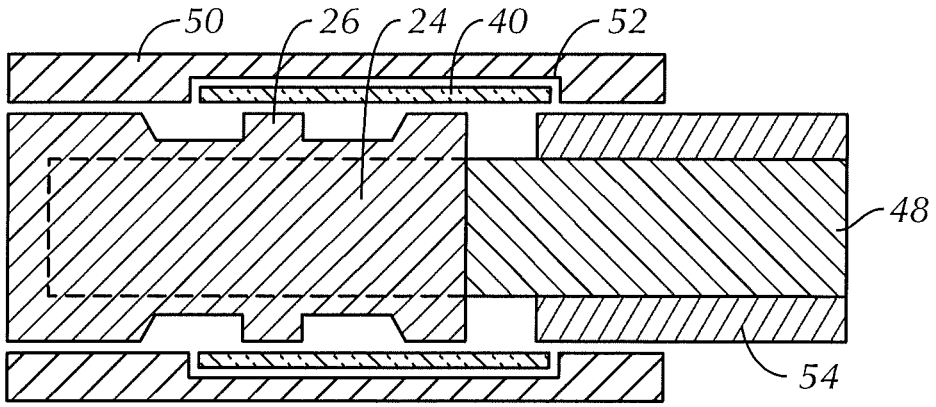
FIG. 3 is a cross-sectional, side view of the cable crimp region of a connector of the present invention.

Inside the connector 10 is a core conductor 22, which has a cable well 24 at one end and a female contact surface 28 at the opposite end. In use, the conductor of the cable is inserted into the well 24 and the core conductor 22 is crimped onto the cable at the crimp region 26. This type of connection is shown in FIG. 3, and described more below.

Between the core conductor 22 and the outer shell 14 and barrel 16 are a series of insulating components. These components are all of generally cylindrical design and are sized to fit within the shell 14. The contact region insulator 30 and the core region insulator 32 are of conventional design. The insulators typically are made of strong, rigid material capable of providing electrical insulation at high temperatures. These two insulator pieces may be made of the same type of insulator material used in prior art connectors of this general type. The insulators are rigid, cylindrical sleeves, with an outside diameter just less than the inside diameter of the shell 14 and an inside diameter just greater than the largest outside diameter of the core conductor 22.

The insulating axial positioner 34 is located between the contact region insulator 30 and the core region insulator 32.

The insulating axial positioner 34 is made of a flexible, and somewhat compressible, insulating material. It is inserted in a retaining groove 44 in the outer surface of the core conductor 22. This arrangement keeps the insulating axial positioner 34 in a fixed position relative to the core conductor 22. Thus, by sizing the contact region insulator 30 and the core region insulator 32 appropriately, the core conductor is positioned appropriately within the shell 14 and barrel 16.

This arrangement can be seen in FIGS. 1 and 2. For example, if the contact region insulator 30 were shorter, and the core region insulator 32 longer, the core conductor would be shifted to the left in FIGS. 1 and 2. Similarly, if the retaining groove 44 is moved, the axial position of the core conductor will move. By fixing these three design aspects (i.e., the length of the two rigid insulators 30, 32, and the axial position of the retaining groove 44), the core conductor is properly positioned within the outer shell 14, and is securely retained in that position, as explained below.

These insulators are held in place by the retaining lip 36, which holds one end of the contact region insulator 30, and the compression shoulder 38 of the barrel 16, which presses against one end of the core region insulator 32. When the shell 14 and barrel 16 are screwed together, the retaining lip 36 and compression shoulder 38 squeeze the three insulating components together. The insulating axial positioner 34 is flexible, but the other two insulating components are not. Thus, when the shell 14 and barrel 16 are screwed together, the insulating axial positioner 34 is slightly compressed. This forces the positioner 34 to expand outward and inward radially, to the extent possible given the physical space constraints.

This slight compression of the insulating axial positioner 34 is important, because it results in a water tight seal on both radial sides of the positioner 34. That is, as the positioner 34 expands outward, it presses against the shell 14, the contact region insulator 30 and the core region insulator 32. Any small space or spaces at this location in the connector will be filled by the expansion of the insulating axial positioner 34. In particular, this expansion seals the positioner 34 against the shell 14.

The same result occurs at the point of contact between the positioner 34 and the core conductor 22. The fit between the insulating axial positioner 34 and the groove 44 in the core conductor 22 is reasonably tight, but the compression of the positioner 34 described above makes this fit very tight, and results in a water tight seal. By sealing on both radial sides, the insulating axial positioner 34 provides an important benefit. As explained below, prior art connectors use additional components to achieve this result.

The male connector 12 shown in FIG. 2 is similar to the female connector just described. The same components exist in the male, with the obvious exception that a solid core male contact 42 is used rather than the female contact 28 seen in FIG. 1. The rest of the design is the same, with the insulating axial positioner 34 being used to properly position and retain the core conductor, and to provide a water tight seal against both the shell 14 and the core conductor 22.

FIGS. 1 and 2 also show an insulating sleeve 40 located radially outward of the crimp region 26. This component is shown in more detail in FIG. 3, which provides a diagram showing a cable connected to a single-pole connector embodying the present invention. The cable conductor 48 is inserted into the cable well 24 and crimped at the crimp region 26. This secures the core conductor 22 to the cable conductor 48 and provides a strong physical and electrical connection. The insulating sleeve 40 is positioned within a recess 52 in the barrel 16.

In practice, the cable conductor 48 is exposed by stripping away some of the cable insulation 54. When the exposed cable conductor 48 is inserted into the cable well 24, a small section of exposed cable conductor 48 may extend outside the cable well 24. This is shown in FIG. 3. The insulating sleeve 40 surrounds this region, thus providing an extra protection against sparking or arcing between the cable conductor 48 and the barrel 16. The barrel 16 and shell 14 are made of metal, but are coated with an electrically insulating layer. It is, however, possible that small gaps in this layer could exist (e.g., due to a manufacturing defect or physical damage to the coating), and the insulating sleeve 40 is used to prevent any sparks or arcs between the cable conductor 48 and such a flawed point of the barrel 16.

The insulating sleeve may be made of any suitable insulating material. It is desirable that the sleeve be thin and flexible. The sleeve may be made of polyethylene, with a thin sheet of an appropriate size rolled and then inserted in the recess 52 in the barrel 16. This sleeve 40 need not have the insulating capabilities of the main insulators 30, 32, because the sleeve's 40 purpose is to protect against possible flaws in the insulating layer of the metallic barrel.

Referring to FIGS. 1-3, it is easy to see how the connector may be assembled. Some steps of the process may come in different sequences, while some steps must occur before or after other steps, as explained below. Two "preliminary" prep steps may be done first. One such step in the installation of the insulating sleeve 40 in the recess 52 of the barrel 16. This step should be done before the barrel 16 and secured to the shell 14, though it is possible to insert the sleeve 40 even after this is done. The other preliminary step is the insertion of the insulating axial positioner 34 into the retaining groove 44 of the core conductor.

The final assembly of the connector involves four steps. The sequence of steps stated here is not intended to limit the invention, as the actual sequence used may vary depending upon the circumstances and the nature of the use. First, the contact region insulator 30 is inserted into the outer shell 14 until the insulator 30 rests against the retaining lip 36. Second, the core conductor 22, which already has the insulating axial positioner 34 in the retaining groove 44, is inserted into the contact region insulator 30 until the insulating axial positioner 34 rests against the contact region insulator 30. Third, the core region insulator 32 may be inserted into the space between the core conductor 22 and the shell 14, until the core region insulator 32 rests against the insulating axial positioner 34. The fourth step of the basic assembly, is to slide the barrel 16 over the outside of the core region insulator 32 and secure the barrel 16 to the shell 14. This step causes the compression shoulder 38 to press against one end of the core region insulator 32, thus slightly compressing the insulating axial positioner 34, as described above.

In practice, there are additional "preliminary" steps that are performed before any of the steps described above are performed. A length of the cable must be stripped of its outer insulation, and the cable conductor 48 inserted into the cable well 24 of the core conductor 22, which is then crimped onto the cable. These steps will be performed before the four basic assembly steps are performed.

In fact, when a connector of this design is installed in the field, the first steps may be to slide certain components over the cable. These components include the cable restraining fitting(s) and possibly other items. This may occur before or after the cable insulation is stripped. It may occur after the core conductor is crimped onto the cable. Once these steps are completed, certain components will be positioned around the cable and the core conductor 22 will be crimped onto the cable. At this point, it may be preferred to slide the barrel 16 over the core conductor 22 and cable. The insulating sleeve 40 will already be in the barrel 16 at this point. The core region insulator 32 may then be slid over the core conductor 22 and into the barrel 16, until it rests against the compression shoulder 38. The insulating axial positioner 34 would then be inserted into the retaining groove 44 and the barrel 16 with the core insulator 32 inside it, would be pulled up against the insulating axial positioner 34. The contact region insulator 30 would then be slid over the contact end of the core conductor 22 and the shell 14 would be slid over the contact region insulator 30. The shell 14 and barrel 16 would then be secured to each other, thus pulling all the key components into place and slightly compressing the insulating axial positioner 34 as described above.

Variations are possible on the retaining structure shown in FIGS. 1-2 and described above. For example, the retaining lip 36 could be replaced by a ridge or lip positioned at some other point on the inside surface of the shell 14. The contact region insulator 30 would then require a mating recess or groove to engage such structure. The important point is that the contact region insulator 30 must be secured axially by the shell 14. Any secure means of achieving this result is within the scope of the present invention. Similarly, the compression should 38 is only one way of retaining the other end of the insulating components. In fact, these components could be secured axially to the core conductor 22, so long as at least one of the rigid insulators 30, 32 is secured axially to the shell 14 or barrel 16. The structure shown in FIGS. 1 and 2 is preferred, but not limiting.

Figure 4:
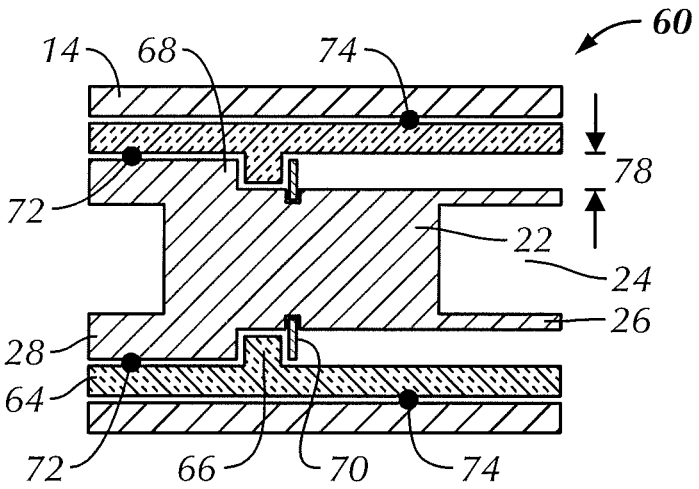
FIG. 4 (Prior Art)
FIG. 4 is a cross-sectional, side view of a female prior art connector.
Figure 5:
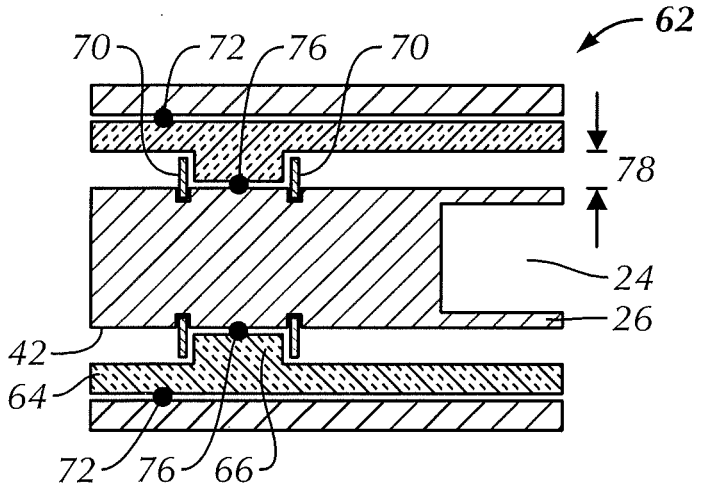
FIG. 5 (Prior Art)
FIG. 5 is a cross-sectional, side view of a male prior art connector.

FIGS. 4 and 5 show prior art connectors, of female 60 and male 62 design, respectively. These are merely diagrams showing certain components of the prior art connectors. The insulator 64 shown in both figures has a substantial ridge 66 that extends radially inward. The insulator 64 is made of a strong, rigid material. To assemble the connector, the core conductor 22 is inserted into the insulator 64, with the retaining shoulder 68 pressing against the insulator ridge 66. To retain these pieces, a snap ring 70 is inserted into a groove in the outer surface of the core conductor 22. The snap ring 70 and the retaining shoulder 68 hold the core conductor 22 in place, relative to the insulator 64.

To provide a water tight seal in this connector, O-rings are used. The contact end O-ring 74 is positioned near the contact end and on the outer surface of the insulator 64. A groove to house the O-ring could be cut into the shell 14 or the insulator 64, but in practice, the insulator is typically the part with the O-ring groove. The contact end O-ring seals the insulator 64 to the shell 14. The cable end O-ring 76 is positioned between the insulator 64 and the core conductor 22. By using two O-rings, the prior art connectors can be effectively sealed.

The functions performed by the O-rings 74 and 76, the insulator ridge 66, the retaining shoulder 68, and the snap ring 70, are all performed by the insulating axial positioner 34 of the present invention. Moreover, the use of snap ring 70 requires a gap 78 between the outside of the crimp region 26 and the insulator 64. This limits the size of the cable, because it limits the size of the cable well 24. In the prior art design, this is a limiting factor. In the present invention, however, snap rings are not used. The gap 78 does not exist in the present invention, because no void is needed for snap rings. The elimination of the gap 78 by the present invention allows for the use of a substantially smaller outer shell 14 and barrel 16.

The insulating axial positioner 34 of the present invention effectively replaces the snap ring(s) and O-rings of the prior art connector. This results in a simple design and it eliminates the gaps needed for the snap-ring and O-rings. The largest gap in the prior art design results from the snap ring(s), and this gap is typically on the order of about 3-5 millimeters. No significant gap between the insulators 30, 32 and the core conductor 22 is required with the present invention. There is enough difference between these parts to allow for easy assembly of the connector, but no additional gap is needed or desired. It is the elimination of the gaps required by the prior art connector's use of snap ring(s) and O-rings that enables the present invention to reduce the overall, outer size of the connector by about 20% for a given size core conductor.

In one preferred embodiment, the present invention is used with a core conductor sized for use with 646 mcm cable. Such a connector has a current rating of about 1,000 amps, which is sufficient for most high-power uses on land-based oil and gas rigs. Prior art connectors of this power rating require use of a size 24 outer casing (i.e., the combined shell and barrel described above). Using the present invention, with the reduced diameter insulators, the same power rated connector can be housed in a size 20 outer casing. This embodiment provides a connector with a current rating of about 1,000 amps in a casing that is about 20% smaller than that used in prior art connectors.

The same comparisons apply to the prior art male connector 62 shown in FIG. 5. The male core conductor has a generally fixed radius, and for that reason, two snap rings 70 are needed. One snap ring is installed on the core conductor 22 before it is inserted into the insulator 64. The second snap ring is installed after the core conductor 22 is positioned in the insulator 64. The gap 78 is present, because space is needed for the snap rings 70, as explained above. In fact, some additional space must be allowed because the second snap ring must be installed with the core conductor 22 inside the insulator 64.

The O-rings used with the prior art male are positioned slightly differently than with the female just described. A contact end O-ring 72 like that described above is used, but an inner O-ring 76 must be installed on the face of the insulator ridge 66, because that is the only part of the insulator 64 in physical contact with the core conductor. This is why the ridge 66 is wider for the prior art male 62.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

The invention claimed is:

1. A single-pole electrical connector, comprising:

a. a core conductor, having a contact end, a cable end, and a retaining groove positioned between the contact end and the cable end;

b. a rigid core region insulator positioned radially outward of the core conductor and extending from a point near the retaining groove toward the cable end;

c. a rigid contact region insulator positioned radially outward of the core conductor and extending from a point at or near the contact end to a point near the retaining groove;

d. an insulating axial positioner located between the rigid core region insulator and the rigid contact region insulator, the insulating axial positioner having a radially inner side and a radially outer side, the radially inner side inserted in the retaining groove of the core conductor; and, e. a shell positioned radially outward of the rigid contact region insulator.

2. The connector of claim 1, wherein the insulating axial positioner is flexible.

3. The connector of claim 1, further comprising a barrel positioned radially outward from the cable end of the core conductor, the barrel configured to be secured to the shell such that the insulating axial positioner is compressed.

4. The connector of claim 3, wherein the compression of the insulating axial positioner creates a water tight seal at the core conductor and at the shell.

5. The connector of claim 3 wherein the barrel and shell are threaded.

6. The connector of claim 1, further comprising a barrel positioned radially outward from the cable end of the core conductor, and an insulating sleeve positioned within a recess in the barrel.

7. The connector of claim 6, wherein the insulating sleeve is positioned such that when the connector is secured to a power cable having a conductive core, the insulating sleeve is between an exposed part of the cable conductive core and the barrel.

8. The connector of claim 5, wherein the core conductor is sized to be compatible with size 646 mcm cable and the shell and barrel are size 20 components.

9. The connector of claim 8, wherein the connector is rated for at least 1,000 A.

10. The connector of claim 5, wherein the core conductor is sized to be compatible with size 777 mcm cable and the shell and barrel are size 20 components.

11. The connector of claim 1, further comprising a. a barrel positioned radially outward from the cable end of the core conductor, the barrel having a compression shoulder; and, b. a retaining lip at the contact end of the shell, wherein the compression shoulder engages with an end of the rigid core region insulator and the retaining lip engages with an end of the rigid contact region insulator, such that when the barrel is secured to the shell, the retaining lip and compression shoulder exert force against the rigid contact region insulator and the rigid core region insulator, respectively.

12. The connector of claim 1 wherein the difference between the inside diameter of the rigid contact region insulator and the outside diameter of the contact end of the core conductor is less than 2 mm.

13. A high-power, single-pole electrical connector, comprising:

a. a core conductor having a contact region, a mid region, and a cable end region, the mid region having a retaining groove;

b. a first insulator positioned around the contact region of the core conductor;

c. a second insulator positioned around at least part of the mid region of the core conductor; and, d. a flexible, insulating axial positioner inserted in the retaining groove of the core conductor and positioned between the first and second insulators.

14. The connector of claim 13, further comprising an outer casing positioned radially outward of the first and second insulators and the insulating axial positioner.

15. The connector of claim 13, further comprising an outer casing and wherein either the first or second insulator is an integral part of the outer casing.

16. The connector of claim 13, wherein the difference between the inside diameter of the first insulator and the outside diameter of the contact region of the core conductor is less than 2 mm.

17. A method of assembling a high-power, single-pole electrical connector comprising the following steps, though the sequence of steps may vary:

a. inserting an insulating axial positioner into a retaining groove in a core conductor;

b. inserting a first rigid insulator into a shell;

c. inserting the core conductor into the first rigid insulator, such that the insulating axial positioner is in contact with the first rigid insulator;

d. inserting a second rigid insulator into the shell;

e. securing a barrel to the shell, such that the first and second rigid insulators compress the insulating axial positioner.

* * * * *